US008916005B2

(12) United States Patent
Cavanaugh et al.

(10) Patent No.: US 8,916,005 B2
(45) **Date of Patent: *Dec. 23, 2014**

(54) SLURRY DIFFUSION ALUMINIDE COATING COMPOSITION AND PROCESS

(75) Inventors: Dennis William Cavanaugh, Simpsonville, SC (US); Canan Uslu Hardwicke, Simpsonville, SC (US); Matthew James OConnell, Simpsonville, SC (US); Todd Steven Moran, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 1020 days.

This patent is subject to a terminal disclaimer.

(21) Appl. No.: 11/940,507

(22) Filed: Nov. 15, 2007

(65) Prior Publication Data

US 2009/0126833 A1 May 21, 2009

(51) Int. Cl.
*C23C 16/12* (2006.01)

(52) U.S. Cl.
USPC ..... 148/240; 148/243; 148/527; 148/559; 148/675; 427/250; 427/255.34; 427/255.39

(58) Field of Classification Search
USPC ..... 148/240, 243, 527, 559, 675; 427/250, 427/255.34, 255.39
See application file for complete search history.

(56) References Cited

U.S. PATENT DOCUMENTS

| | | | | |
|---|---|---|---|---|
| RE29,212 | E | 5/1977 | Baldi et al. | |
| 5,217,757 | A | 6/1993 | Olson et al. | |
| 5,366,765 | A * | 11/1994 | Milaniak et al. | 427/229 |
| 6,022,632 | A * | 2/2000 | Olson et al. | 428/650 |
| 6,110,262 | A * | 8/2000 | Kircher et al. | 106/14.44 |
| 6,444,054 | B1 | 9/2002 | Kircher et al. | |
| 6,730,179 | B2 | 5/2004 | Kircher | |
| 2004/0115355 | A1 * | 6/2004 | Bauer et al. | 427/376.1 |
| 2005/0031877 | A1 | 2/2005 | Gigliotti | |
| 2006/0141283 | A1 * | 6/2006 | Madhava | 428/651 |
| 2007/0009660 | A1 | 1/2007 | Sasaki et al. | |

FOREIGN PATENT DOCUMENTS

| | | | |
|---|---|---|---|
| JP | 5696067 | A | 8/1981 |
| JP | 63190158 | A | 8/1988 |
| JP | 2003183809 | A | 7/2003 |
| JP | 2006199988 | A | 8/2006 |

OTHER PUBLICATIONS

Unofficial English translation of Office Action issued in connection with corresponding JP Application No. 2008-291671 on Oct. 29, 2013.

* cited by examiner

*Primary Examiner* — Lois Zheng
(74) *Attorney, Agent, or Firm* — Ernest G. Cusick; Gary M. Hartman; Domenica N.S. Hartman

(57) ABSTRACT

A slurry and slurry coating process for forming a diffusion aluminide coating on a substrate, including internal surfaces within the substrate. The process involves preparing a slurry of a powder containing a metallic aluminum alloy having a melting temperature higher than aluminum, an activator capable of forming a reactive halide vapor with the metallic aluminum, and a binder containing an organic polymer. The slurry is applied to surfaces of the substrate, which is then heated to burn off the binder, vaporize and react the activator with the metallic aluminum to form the halide vapor, react the halide vapor at the substrate surfaces to deposit aluminum on the surfaces, and diffuse the deposited aluminum into the surfaces to form a diffusion aluminide coating. The process can be tailored to selectively produce an inward or outward-type coating. The binder burns off to form an ash residue that can be readily removed.

19 Claims, 1 Drawing Sheet

SLURRY DIFFUSION ALUMINIDE COATING COMPOSITION AND PROCESS

BACKGROUND OF THE INVENTION

The present invention relates to processes and compositions for forming diffusion coatings. More particularly, this invention relates to a slurry coating composition and process for forming a diffusion aluminide coating on a substrate surface.

The hot gas path within a gas turbine engine is both thermally and chemically hostile. Significant advances in high temperature capabilities have been achieved through the development of iron, nickel and cobalt-base superalloys and the use of oxidation-resistant environmental coatings capable of protecting superalloys from oxidation, hot corrosion, etc. Aluminum-containing coatings, particularly diffusion aluminide coatings, have found widespread use as environmental coatings on gas turbine engine components. During high temperature exposure in air, aluminum-containing coatings form a protective aluminum oxide (alumina) scale or layer that inhibits corrosion and oxidation of the coating and the underlying substrate.

Diffusion coatings can be generally characterized as having an additive layer that primarily overlies the original surface of the coated substrate, and a diffusion zone below the original surface. The additive layer of a diffusion aluminide coating contains the environmentally-resistant intermetallic phase MAl, where M is iron, nickel or cobalt, depending on the substrate material (mainly β(NiAl) if the substrate is Ni-base). The diffusion zone comprises various intermetallic and metastable phases that form during the coating reaction as a result of diffusional gradients and changes in elemental solubility in the local region of the substrate.

Components located in certain sections of gas turbine engines, such as the turbine, combustor and augmentor, often require some form of thermal protection in addition to an environmental coating. One approach is to deposit a ceramic thermal barrier coating (TBC) on the external surfaces of the component. Another approach is to configure the component to provide cooling air flow through internal passages within the component. For more demanding applications, it can be necessary to utilize internal cooling in combination with a TBC. Temperatures inside internal cooling passages can be sufficiently high to require a diffusion aluminide coating for oxidation protection. Because the size and geometry of the internal passages and cooling holes of air-cooled components are critical to maintaining the required amount of coolant flow, processes by which diffusion aluminide coatings are deposited on the external and internal surfaces of air-cooled components should be capable of producing coatings of uniform thickness and leave minimal residue that would negatively affect the cooling flow through the component.

Diffusion aluminide coatings are generally formed by depositing and diffusing aluminum into the surface of a component at temperatures at or above about 1400° F. (about 760° C.). Notable processes include pack cementation and vapor phase aluminizing (VPA) techniques, and diffusing aluminum deposited by chemical vapor deposition (CVD), slurry coating, or another deposition process. Pack cementation and VPA processes generally involve the use of an activator to transport aluminum from an aluminum source to the surface of the component being coated. For example, a halide activator (typically ammonium halide or an alkali metal halide) can be reacted with an aluminum-containing source (donor) material to form an aluminum halide gas (such as aluminum fluoride ($AlF_3$) or aluminum chloride ($AlCl_3$)) that travels to the surface of the component, where it reacts to reform and deposit aluminum. In contrast, aluminum deposited by slurry coating is typically diffused without an activator, relying instead on melting and subsequent diffusion of the deposited aluminum.

The processing temperature and whether an activator is used will influence whether a diffusion coating is categorized as an outward-type or inward-type. Outward-type coatings are formed as a result of using higher temperatures (e.g., at or near the solution temperature of the alloy being coated) and lower amounts of activator as compared to inward-type coatings. In the case of a nickel-based substrate, such conditions promote the outward diffusion of nickel from the substrate into the deposited aluminum layer to form the additive layer, and also reduce the inward diffusion of aluminum from the deposited aluminum layer into the substrate, resulting in a relatively thick additive layer above the original surface of the substrate. Conversely, lower processing temperatures and larger amounts of activator reduce the outward diffusion of nickel from the substrate into the deposited aluminum layer and promote the inward diffusion of aluminum from the deposited aluminum layer into the substrate, yielding an inward-type diffusion coating characterized by an additive layer that extends below the original surface of the substrate. The choice of donor material influences whether an outward or inward-type diffusion coating can be produced, since aluminum alloys such as CrAl, CoAl, FeAl, TiAl, etc., have higher melting temperatures than unalloyed aluminum and therefore can be used with the higher processing temperatures used to form outward-type coatings. Though both outward and inward-type diffusion aluminide coatings are successfully used, outward-type diffusion aluminide coatings typically have a more ductile and stable nickel aluminide intermetallic phase and exhibit better oxidation and low cycle fatigue (LCF) properties as compared to inward-type diffusion aluminide coatings.

Pack cementation and VPA processes are widely used to form aluminide coatings because of their ability to form coatings of uniform thickness. In pack cementation processes, the aluminum halide gas is produced by heating a powder mixture comprising the source material, the activator, and an inert filler such as calcined alumina. The ingredients of the powder mixture are mixed and then packed and pressed around the component to be treated, after which the component and powder mixture are heated to a temperature sufficient to vaporize the activator. The vaporized activator reacts with the source material to form the volatile aluminum halide, which then reacts at the component surface to form a aluminide coating, typically a brittle inward-type coating with high aluminum content due to the use of a relatively low treatment temperature to minimize sintering of the pack material and high activity required of the activator to offset the dilution effect of the inert filler. In contrast, VPA processes are carried out with the source material placed out of contact with the surface to be aluminized. Depending on the processing temperature and amount of activator used, VPA coatings can be inward or outward-type.

A disadvantage of performing a pack cementation process on an air-cooled component is that particles of the source material and inert filler can sinter and become trapped in the cooling passages and holes, requiring labor-intensive removal of the particles so as not to negatively affect cooling flow through the component. On the other hand, a difficulty encountered with VPA processes is the inability to produce a uniform aluminide coating on all internal passages of a component.

Slurries used to form diffusion aluminide coatings are typically aluminum rich, containing only an unalloyed aluminum powder in an inorganic binder. The slurry is directly applied to surfaces to be aluminized, and aluminizing occurs as a result of heating the component in a non-oxidizing atmosphere or vacuum to a temperature above 1400° F. (about 760° C.), which is maintained for a duration sufficient to melt the aluminum powder and diffuse the molten aluminum into the surface. The thickness of a diffusion aluminide coating produced by a slurry method is typically proportional to the amount of the slurry applied to the surface, and as such the amount of slurry applied must be very carefully controlled. The difficulty of consistently producing diffusion aluminide coatings of uniform thickness has discouraged the use of slurry processes on components that require a very uniform diffusion coating and/or have complicated geometries, such as air-cooled turbine blades. As a result, though capable of forming diffusion aluminide coatings on internal and external surfaces, slurry coating processes have been typically employed to coat limited, noncritical regions of gas turbine engine components. Another limitation of slurry coating processes is that, because of the use of unalloyed aluminum, they are typically performed at relatively low temperatures (e.g., below 1800° F./980° C.), and are therefore limited to producing an inward-type coating with high aluminum content.

U.S. Pat. No. 6,444,054 to Kircher et al. discloses an alternative slurry composition that contains an activator and produces an inward-type diffusion aluminide coating. The slurry composition contains a chromium-aluminum (Cr—Al) alloy powder, lithium fluoride (LiF) as the activator, and an organic binder such as hydroxypropylcellulose dissolved in a solvent. As with pack cementation and VPA processes, the LiF activator vaporizes and reacts with the aluminum in the alloy powder to form a volatile aluminum halide, which then reacts at the component surface to form an aluminide coating. According to Kircher et al., the applied slurry coating is heated to a temperature of about 1600° F. to about 2000° F. (about 870° C. to about 1090° C.) to form the inward-type diffusion aluminide coating. The ability to form inward-type coatings over such a wide range of temperatures appears to be the result of the particular activator used, LiF, being highly reactive. The coating is said to have a uniform thickness that is largely independent of the as-applied slurry coating thickness. However, slurry thicknesses of greater than 0.050 inch (about 1.3 mm) are not attempted. Finally, Kircher et al.'s slurry leaves residues that are said to be removed by wire brush, glass bead or oxide grit burnishing, high pressure water jet, or other conventional methods, suggesting that the residues are firmly attached to the coating surface. As such, it appears that Kircher et al.'s slurry is not suitable for use on internal surfaces that cannot be reached by such surface treatments.

There is an ongoing need for coating processes that are capable of depositing diffusion aluminide coatings of uniform thickness on internal and external surfaces, and that do not entail labor-intensive cleaning to remove coating residue remaining at the completion of the coating process. It would be particularly desirable if such a process was capable of being performed over a wide range of temperatures and capable of forming both inward and outward-type diffusion aluminide coatings.

BRIEF SUMMARY OF THE INVENTION

The present invention is a slurry and slurry coating process for forming diffusion aluminide coatings on a substrate surfaces, and particularly surfaces of an air-cooled component with internal cooling passages and surface cooling holes. The slurry is tailored for use over a wide range of temperatures, allowing the slurry to be used to form either an inward-type or outward-type diffusion aluminide coating, depending on the desired properties of the coating.

According to a first aspect of the invention, the slurry coating process involves preparing a slurry containing a powder containing a metallic aluminum alloy having a melting temperature higher than aluminum, an activator capable of forming a reactive halide vapor with the metallic aluminum, and a binder containing an organic polymer, such as an alcohol-based and/or water-based organic polymer. The slurry is applied to surfaces of a component and then heated to burn off the binder, vaporize and react the activator with the metallic aluminum to form the halide vapor, react the halide vapor at the surfaces of the component to deposit aluminum on the surfaces, and diffuse the deposited aluminum into the surfaces of the component to form a diffusion aluminide coating. According to a preferred aspect of the invention, the slurry can be heated to a wide range of temperatures, such as about 1500° F. to about 2100° F. (about 815° C. to about 1150° C.), for the purpose of selectively forming an inward-type or outward-type diffusion aluminide coating. Another preferred aspect of the invention is that the binder burns off to form an ash residue that can be readily removed, such as by directing a gas such as air at the diffusion aluminide coating on the coated component surface.

According to another aspect of the invention, a slurry is provided for forming a diffusion aluminide coating on a surface of a component. The slurry contains, by weight, about 35 to about 65% of a powder containing a metallic aluminum alloy having a melting temperature higher than aluminum, about 1 to about 25% of an activator capable of forming a reactive halide vapor with the metallic aluminum, and about 25 to about 60% of an organic polymer.

The slurry and slurry coating process of this invention are capable of producing a diffusion aluminide coating without the use of inert fillers and binders that leave residues that are difficult to remove after the coating process. As such, the coating process and slurry are well suited for use on air-cooled components on whose internal and external surfaces a diffusion aluminide coating is desired. Furthermore, the slurry and slurry coating process have been shown to be capable of forming a uniform diffusion aluminide coating whose thickness is essentially independent of the thickness of the applied slurry prior to heating. As such, the slurry can be applied by a variety of techniques, individually or in any combination, including spraying, dipping, brushing, injection, etc. The slurry has also been shown to be capable of producing diffusion aluminide coatings over a range of about 1500° F. to about 2100° F. (about 815° C. to about 1150° C.), and over such a temperature range can be formed as an inward-type or outward-type coating to have properties tailored for a given application.

Other objects and advantages of this invention will be better appreciated from the following detailed description.

DETAILED DESCRIPTION OF THE INVENTION

The present invention will be described in reference to a gas turbine engine turbine blade 10 represented in FIG. 1 and provided with cooling holes 18 and a diffusion aluminide coating 20, the latter of which are represented in cross-section in FIG. 2. While the advantages of this invention will be described with reference to the blade 10, the teachings of this invention are applicable to other air-cooled components of gas turbine engines, as well as being generally applicable to other components that benefit from the protection of diffusion coatings.

Figure 1:
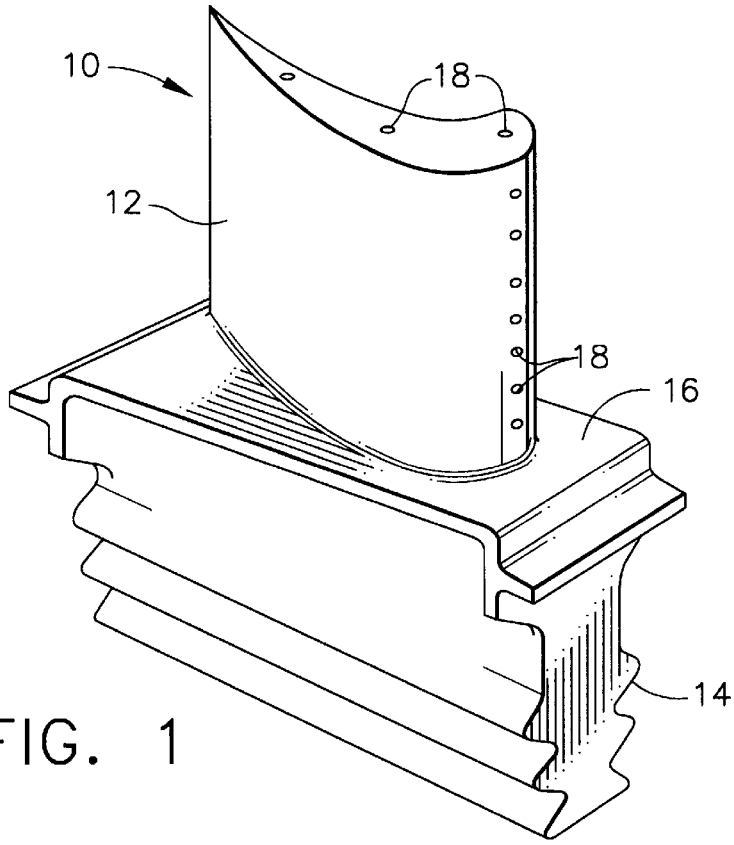
FIG. 1 shows an air-cooled high pressure turbine blade, which is representative of a type of component suitable for receiving a diffusion aluminide coating in accordance with the present invention.

The blade 10 shown in FIG. 1 is a high pressure turbine blade that may be formed of an iron, nickel or cobalt-base superalloy, with nickel-base superalloys being preferred. The blade 10 includes an airfoil section 12 and platform 16 against which hot combustion gases are directed during operation of the gas turbine engine, and whose surfaces are therefore subjected to severe attack by oxidation, corrosion and erosion. The airfoil section 12 is configured to be anchored to a turbine disk (not shown) with a dovetail 14 formed on a root section of the blade 10. Cooling holes 18 are present in the airfoil section 12 through which bleed air is forced to transfer heat from the blade 10 and film cool the surrounding surfaces of the airfoil section 12.

Figure 2:
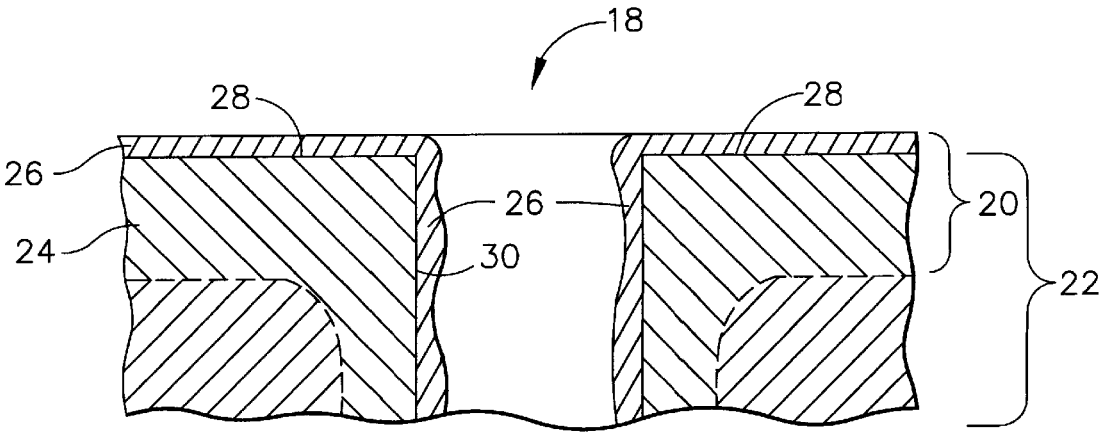
FIG. 2 is a partial sectional view through a cooling hole of the airfoil section of the blade shown in FIG. 1, and shows a diffusion aluminide coating on internal and external surfaces of the blade.

The airfoil section 12 is protected from the hostile environment of the turbine section by the diffusion aluminide coating 20, shown in FIG. 2 as being formed on a substrate region 22 of the blade 10. The substrate region 22 may be the base superalloy of the blade 10, or an overlay coating such as MCrAlY deposited by known methods on the surface of the blade 10. When subjected to sufficiently high temperatures in an oxidizing atmosphere, the aluminide coating 20 develops an alumina ($Al_2O_3$) layer or scale (not shown) on its surface that inhibits oxidation of the diffusion coating 20 and the underlying substrate region 22. As shown in FIG. 2, the diffusion aluminide coating 20 not only overlies external surfaces 28 of the blade 10 (such as the airfoil section 12 and platform 16), but is also deposited on internal surfaces 30 of the blade 10, including the walls of the cooling hole 18 and internal cooling passages (not shown) that interconnect the cooling holes 18 of the blade 10 with a cooling air source.

Though not shown in FIG. 2, the external surfaces of the airfoil 12 and platform 16 may be further protected by a thermal barrier coating (TBC) deposited on the aluminide coating 20. The TBC may be deposited by thermal spraying such as air plasma spraying (APS), low pressure plasma spraying (LPPS) and HVOF, or by a physical vapor deposition technique such as electron beam physical vapor deposition (EBPVD). Preferred TBC materials are zirconia partially stabilized with yttria (yttria-stabilized zirconia, or YSZ), though zirconia fully stabilized with yttria could be used, as well as zirconia stabilized by other oxides.

The aluminide coating 20 is represented in FIG. 2 as having two distinct zones, an outermost of which is an additive layer 26 that contains environmentally-resistant intermetallic phases such as MAI, where M is iron, nickel or cobalt, depending on the substrate material. The chemistry of the additive layer 26 may be modified by the addition of elements, such as chromium, silicon, platinum, rhodium, hafnium, yttrium and zirconium, for the purpose of modifying the environmental and physical properties of the coating 20. A typical thickness for the additive layer 26 is up to about 75 micrometers. Beneath the additive layer 26 is a diffusion zone (DZ) 24 that typically extends about 25 to 50 micrometers into the substrate region 22. The diffusion zone 24 comprises various intermetallic and metastable phases that form during the coating reaction as a result of diffusional gradients and changes in elemental solubility in the local region of the substrate. These phases are distributed in a matrix of the substrate material.

According to this invention, the diffusion aluminide coating 20 is formed by a slurry process by which aluminum is deposited and diffused into the surfaces 28 and 30 to form aluminide intermetallics. The slurry process makes use of an aluminum-containing slurry whose composition includes a donor material containing metallic aluminum, a halide activator, and a binder containing an organic polymer. Notably missing from the ingredients of the slurry compositions are inert fillers and inorganic binders. In the absence of inert fillers, whose particles are prone to sintering and becoming entrapped in cooling passages and holes of air-cooled component, the coating process and slurry composition of this invention are well suited for use on such air-cooled components, including but not limited to the blade 10 of FIG. 1.

Suitable donor materials are aluminum alloys with higher melting temperatures than aluminum (melting point of about 660° C.). Particularly suitable donor metals include metallic aluminum alloyed with chromium, cobalt, iron, and/or another aluminum alloying agent with a sufficiently higher melting point so that the alloying agent does not deposit during the diffusion aluminiding process, but instead serves as an inert carrier for the aluminum of the donor material. Preferred donor materials are chromium-aluminum alloys. An alloy that appears to be particularly well-suited for diffusion processes performed over the wide range of temperatures contemplated by this invention is believed to be 56Cr-44Al (about 44 weight percent aluminum, the balance chromium and incidental impurities). The donor material is in the form of a fine powder to reduce the likelihood that the donor material would become lodged or entrapped within the blade 10. For this reason, a preferred particle size for the donor material powder is −200 mesh (a maximum dimension of not larger than 74 micrometers), though it is foreseeable that powders with a mesh size of as large as 100 mesh (a maximum dimension of up to 149 micrometers) could be used.

Suitable halide activators include ammonium chloride ($NH_4Cl$), ammonium fluoride ($NH_4F$), and ammonium bromide ($NH_4Br$), though the use of other halide activators is also believed to be possible. Suitable activators must be capable of reacting with aluminum in the donor material to form a volatile aluminum halide (e.g., $AlCl_3$, $AlF_3$) that reacts at the surfaces 28 and 30 of the blade 10 to deposit aluminum, which is then diffused into the surfaces 28 and 30 to form the diffusion aluminide coating 20. A preferred activator for a given process will depend on what type of aluminide coating desired. For example, chloride activators promote a slower reaction to produce a thinner and/or outward-type coating, whereas fluoride activators promote a faster reaction capable of producing thicker and/or inward-type coatings. For use in the slurry, the activator is in a fine powder form. In some embodiments of the invention, the activator powder is preferably encapsulated to inhibit the absorption of moisture.

Suitable binders preferably consist essentially or entirely of alcohol-based or water-based organic polymers. A preferred aspect of the invention is that the binder is able to burn off entirely and cleanly at temperatures below that required to vaporize and react the halide activator, with the remaining residue being essentially in the form of an ash that can be easily removed, for example, by forcing a gas such as air over the surfaces 28 and 30 following the diffusion process. The use of a water-based binder generally necessitates the above-noted encapsulation of the activator powder to prevent dissolution, while the use of an alcohol-based binder does not.

Commercial examples of suitable water-based organic polymeric binders include a polymeric gel available under the name Vitta Braz-Binder Gel from the Vitta Corporation. Suitable alcohol-based binders can be low molecular weight polyalcohols (polyols), such as polyvinyl alcohol (PVA). The binder may also incorporate a cure catalyst or accelerant such as sodium hypophosphite. It is foreseeable that other alcohol or water-based organic polymeric binders could also be used.

Suitable slurry compositions for use with this invention have a solids loading (donor material and activator) of about 10 to about 80 weight percent, with the balance binder. More particularly, suitable slurry compositions of this invention contain, by weight, about 35 to about 65% donor material powder, about 25 to about 60% binder, and about 1 to about 25% activator. More preferred ranges are, by weight, about 35 to about 65% donor material powder, about 25 to about 50% binder, and about 5 to about 25% activator. Within these ranges, the slurry composition has consistencies that allow its application to the external and internal surfaces 28 and 30 of the blade 10 by a variety of methods, including spraying, dipping, brushing, injection, etc.

According to an advantageous aspect of the invention, slurries of this invention can be applied to have nonuniform green state (i.e., undried) thicknesses, yet produce diffusion aluminide coatings of very uniform thickness. For example, slurry coatings deposited to have thicknesses of about 0.010 inch (about 0.25 mm) to about 1 inch (about 25 mm) and greater have been shown to produce diffusion aluminide coatings whose thicknesses are very uniform, for example, vary by as little as about 0.0005 inch (about 0.01 mm) or less. As a result, slurry compositions of this invention can be applied to the blade 10 using a combination of methods, such as injection into the cooling holes 18 and internal passages to coat the internal surfaces 30 of the blade 10, and spraying, dipping, brushing, etc., to coat the external surfaces 28 of the blade 10.

Another advantageous aspect of the invention is that the slurry coating composition is capable of producing diffusion aluminide coatings 20 over a broad range of diffusion treatment temperatures, generally in a range of about 1500° F. to about 2100° F. (about 815° C. to about 1150° C.). Within this broad range, the diffusion temperature can be tailored to preferentially produce either an inward or outward-type coating, along with the different properties associated with these different types of coatings. For example, the high temperature capability of the slurry composition of this invention enables the production of an outward-type diffusion aluminide coating which, as previously noted, is typically more ductile, has a more stable nickel aluminide intermetallic phase, and exhibits better oxidation and LCF properties as compared to inward-type diffusion aluminide coatings. It is believed the particular types and amounts of donor material and activator can also be used to influence whether an inward or outward-type coating is produced within the above-noted treatment temperature range.

After applying the slurry to the surfaces 28 and 30 of the blade 10, the blade 10 can be immediately placed in a coating chamber (retort) to perform the diffusion process. Additional coating or activator materials are not required to be present in the retort, other than what is present in the slurry. The retort is evacuated and preferably backfilled with an inert or reducing atmosphere (such as argon or hydrogen, respectively). The temperature within the retort is then raised to a temperature sufficient to burn off the binder, for example about 300° F. to about 400° F. (about 150° C. to about 200° C.), with further heating being performed to attain the desired diffusion temperature as described above, during which time the activator is volatilized, the aluminum halide is formed, aluminum is deposited on the surfaces 28 and 30 of the blade 10. The blade 10 is held at the diffusion temperature for a duration of about one to about eight hours, again depending on the final thickness desired for the coating 20.

Following the coating process, the blade 10 is removed from the retort and cleaned of any residues from the coating process remaining in and on the blade 10. Such residues have been observed to be essentially limited to an ash-like residue of the binder and residue of donor material particles, the latter of which is primarily the metallic constituent (or constituents) of the donor material other than aluminum. In any case, the residues remaining following the coating process of this invention have been found to be readily removable, such as with forced gas flow, without resorting to more aggressive removal techniques such as wire brushing, glass bead or oxide grit burnishing, high pressure water jet, or other such methods that entail physical contact with a solid or liquid to remove firmly attached residues. Because of the ease with which the residues can be removed, the coating process of this invention is well suited for depositing coatings on surfaces (e.g., the internal surfaces 28 of the blade 10) that cannot be reached by the aforementioned aggressive surface treatments.

During an investigation leading to this invention, internal and external surfaces of air-cooled first stage buckets for the General Electric MS6001B gas turbine engine and air-cooled first stage high pressure turbine blades (HPTB) for the General Electric CFM56 gas turbine engine were successfully coated using a slurry composition within the scope of this invention. The slurry was prepared by mixing a −200 mesh 56Cr-44Al alloy powder and ammonium fluoride powder, to which the Vitta Braz-Binder Gel was added and blended. The resulting slurry contained about 50 weight percent of the alloy powder, about 15 weight percent of the activator, and about 35 weight percent of the Braz-Binder Gel binder, yielding a free-flowing consistency. To achieve slurry coatings of various green state thicknesses on each test specimen, a thin layer of the slurry (about 0.01 inch (about 0.25 mm) thick) was applied to the airfoils of the buckets and blades using a wiping technique, while other regions of the buckets and blades were painted with the slurry to achieve slurry coating thicknesses of about 0.25 inch (about 6 mm).

The specimens were heated in a retort containing hydrogen or argon gas. The heating cycle entailed heating to burn off the binder and then vaporize and react the activator with the aluminum of the donor material. Heating continued to a treatment temperature of about 1900° F. (about 1040° C.), which was held for a duration of about four hours. At the completion of the heat treatment, the buckets and blades were cleaned with compressed air to remove an ash residue, and their diffusion aluminide coatings were metallographically analyzed. All coatings were of the inward-type due to the relative low treatment temperature. The coatings on all regions of all specimens were determined to have thicknesses of about 0.0020 inch (about 50 micrometers), evidencing that the thicknesses of the coatings were essentially independent of the green state thickness of the slurry over the broad tested range, within which the slurry coating thickness varied by a factor of about 25.

While the invention has been described in terms of a preferred embodiment, it is apparent that other forms could be adopted by one skilled in the art. Accordingly, the scope of the invention is to be limited only by the following claims.

The invention claimed is:

1. A process of forming a diffusion aluminide coating on surfaces of a component, the process comprising:

preparing a slurry consisting of a donor powder containing a metallic aluminum alloy having a melting temperature higher than aluminum, an activator powder that forms a reactive halide vapor with aluminum in the aluminum alloy, and a binder that consist of at least one organic polymer gel;

applying the slurry to the surfaces of the component; and then heating the component to burn off the binder, vaporize and react the activator powder with the metallic aluminum to form the halide vapor, react the halide vapor at the surfaces of the component to deposit aluminum on the surfaces, and diffuse the deposited aluminum into the surfaces of the component to form a diffusion aluminide coating, wherein the binder burns off to form a readily removable residue, wherein the slurry consists of, by weight, about 35 to about 65% of the donor powder, about 1 to about 25% of the activator powder, and about 25 to about 60% of the binder.

2. The process according to claim 1, wherein the donor powder contains a chromium-aluminum alloy.

3. The process according to claim 1, wherein the donor powder has a particle size of up to 100 mesh.

4. The process according to claim 1, wherein the activator powder is chosen from the group consisting of ammonium chloride, ammonium fluoride, and ammonium bromide.

5. The process according to claim 1, wherein the donor powder consists essentially of a chromium-aluminum alloy.

6. The process according to claim 1, wherein the donor powder has a particle size of up to 100 mesh.

7. The process according to claim 1, wherein the activator powder is chosen from the group consisting of ammonium chloride, ammonium fluoride, and ammonium bromide.

8. The process according to claim 1, wherein the surfaces comprise at least one external surface of the component.

9. The process according to claim 1, wherein the surfaces comprise internal surfaces within the component and external surfaces of the component.

10. The process according to claim 1, wherein the slurry coating has a maximum thickness of about 25 mm.

11. The process according to claim 1, wherein the component is heated to a temperature within a range of about 815° C. to about 1150° C.

12. The process according to claim 1, wherein the diffusion aluminide coating is an inward-type coating.

13. The process according to claim 1, wherein the diffusion aluminide coating is an outward-type coating.

14. The process according to claim 1, wherein the component is an air-cooled gas turbine engine component.

15. The process according to claim 1, wherein the component is formed of a nickel-based superalloy.

16. The process according to claim 1, further comprising removing the residue by directing forced gas flow at the diffusion aluminide coating.

17. The process according to claim 1, wherein applying the slurry to surfaces of the component forms a slurry coating having a nonuniform thickness with a minimum thickness of about 0.25 mm and a maximum thickness of about 6 mm or more and the diffusion aluminum coating has a thickness which varies by about 0.01 mm or less and is therefore essentially independent of the thickness of the slurry coating.

18. A process of forming a diffusion aluminide coating on surfaces of a component, the process comprising:

preparing a slurry consisting of a donor powder containing a metallic aluminum alloy having a melting temperature higher that aluminum, an activator powder that forms a reactive halide vapor with aluminum in the aluminum alloy, and a binder that consists of at least one organic polymer gel;

applying the slurry to the surfaces of the component wherein the surfaces comprise at least one internal surface within the component; and then heating the component to burn off the binder, vaporize and react the activator powder with the metallic aluminum to form the halide vapor, react the halide vapor at the surfaces of the component to deposit aluminum on the surfaces, and diffuse the deposited aluminum into the surfaces of the component to form a diffusion aluminide coating, wherein the binder burns off to form a readily removable residue.

19. A process of forming a diffusion aluminide coating on surfaces of a component, the process comprising:

preparing a slurry consisting of a donor powder containing a metallic aluminum alloy having a melting temperature higher than aluminum, an activator powder that forms a reactive halide vapor with aluminum in the aluminum alloy, and a binder that consists of at least one organic polymer gel wherein the at least one organic polymer gel of the binder is a water-based organic polymer gel and the activator powder is encapsulated to inhibit the absorption of moisture;

applying the slurry to the surfaces of the component; and then heating the component to burn off the binder, vaporize and react the activator powder with the metallic aluminum to form the halide vapor, react the halide vapor at the surfaces of the component to deposit aluminum on the surfaces, and diffuse the deposited aluminum into the surfaces of the component to form a diffusion aluminide coating, wherein the binder burns off to form a readily removable residue.

* * * * *